US006679794B1

(12) United States Patent
Vitello et al.

(10) Patent No.: US 6,679,794 B1
(45) Date of Patent: Jan. 20, 2004

(54) BASKETBALL SHOOTING TRAINER AND METHOD

(75) Inventors: John J. Vitello, Cheshire, CT (US); Paul J. Vitello, Wallingford, CT (US)

(73) Assignee: Vi-able, LLC, Meriden, CT (US)

( * ) Notice: Subject to any disclaimer, the term of this patent is extended or adjusted under 35 U.S.C. 154(b) by 0 days.

(21) Appl. No.: 10/049,927

(22) PCT Filed: Aug. 18, 2000

(86) PCT No.: PCT/US00/22614

§ 371 (c)(1),
(2), (4) Date: Feb. 20, 2002

(87) PCT Pub. No.: WO01/14022

PCT Pub. Date: Mar. 1, 2001

Related U.S. Application Data

(60) Provisional application No. 60/150,059, filed on Aug. 20, 1999.

(51) Int. Cl.[7] ..... A63B 69/00
(52) U.S. Cl. ..... 473/433
(58) Field of Search ..... 473/433, 415, 473/417, 422, 447, 448, 450, 429

(56) References Cited

U.S. PATENT DOCUMENTS

| | | | |
|---|---|---|---|
| 2,690,911 | A | 10/1954 | Newgren |
| 3,675,921 | A | 7/1972 | Meyers, Sr. |
| 3,820,783 | A | 6/1974 | Caveness |
| 4,383,685 | A | 5/1983 | Bishop |
| 4,538,808 | A | 9/1985 | Holland |
| 4,579,341 | A | 4/1986 | Furr |
| 4,623,148 | A | 11/1986 | Juhl |
| 4,717,149 | A | 1/1988 | Juhl |
| 5,160,138 | A | 11/1992 | Sanders |
| 5,324,026 | A | 6/1994 | Conlon et al. |
| 5,485,993 | A | 1/1996 | Lipsett |
| 5,582,402 | A | 12/1996 | Gilford |
| 5,599,016 | A | 2/1997 | Larkin |
| 5,665,016 | A | 9/1997 | Burnett |
| 5,800,291 | A | 9/1998 | Grover |
| 5,816,952 | A | 10/1998 | Blevins |
| 5,833,556 | A | 11/1998 | Ferrari |
| 5,865,695 | A | 2/1999 | Mahala et al. |

OTHER PUBLICATIONS

Shotmaker™, *Basketball Coaching and Training Aids, 1989 School Mail Order Catalog*, Korney Board Aids, Roxton, TX.

*Primary Examiner*—Paul T. Sewell
*Assistant Examiner*—M. Chambers
(74) *Attorney, Agent, or Firm*—Wiggin & Dana, LLP; Gregory S. Rosenblatt; Michael K. Kinney

(57) ABSTRACT

An apparatus (40) is used to implement a method for training a person to accomplish a basketball shot. A lower body positioning member (60) is located in front of a leg area of the person when that person is in a position to attempt the shot. When the person so attempts the shot, the lower body positioning member restrains forward rotation of the person's leading shin. An upper body positioning member (68) is located in front of a torso area of the person. When the person attempts the shot, the upper body positioning member restrains downward rotation of the person's shooting arm. In a repetitive process, the person is provided with a basketball and shoots the basketball at the goal. By this repetitive process the person learns to accomplish the shot without excessive rotation of the lower leg and upper arm.

9 Claims, 8 Drawing Sheets

BASKETBALL SHOOTING TRAINER AND METHOD

This patent application is the 35 U.S.C. 371 National Phase of PCT/US00/22614 filed. Aug. 18, 2000 and published in English on Mar. 1, 2001 and claims priority of U.S. Provisional Patent Application Ser. No. 60/150,059 entitled "BASKETBALL SHOOTING TRAINER AND METHOD" that was filed on Aug. 20, 1999, the disclosure of which is incorporated by reference in its entirety herein.

This invention relates to basketball, and more particularly to a method and apparatus for training a person to shoot free-throws.

A key aspect of the basketball free-throw or foul shot is the consistent environment presented to the player. From court to court, the distances involved in making the shot will be entirely consistent as are the particular properties of the equipment and environment largely relevant to accomplishing the shot. The absence of a defender attempting to block the shot removes any strategy considerations. Therefore, the ability to successfully make free-throws is a highly trainable skill. The most common method of training is simple unaided repetition. Unaided repetition is highly inefficient and has sporadic results.

In attempts to increase training efficiency and improve training results, a variety of techniques and associated equipment have been developed. Little of the equipment is in common use. There have been a number of patented brace-like structures configured to be worn on the user's arm to restrict or otherwise guide motion (typically of the wrist) in a desired fashion. These orthotic structures appear to be awkward, address a limited aspect of the shooting motion, are not specifically tailored to foul shooting, and suffer from the inherent deficiency that their weight and restriction train the users to shoot under different circumstances than are actually encountered in a game. Other patented training devices involve fixed structures which have a mechanically-guided mock basketball and, appear to resemble exercise equipment. Such machines can only aspire to mimic the "feel" of shooting a basketball, and are no substitute for the actual thing.

U.S. Pat. No. 5,599,016 shows a free-standing device which is purported to develop muscle memory relative to proper hand, wrist, and arm movement, and, in particular to the follow through of the shooting hand after release of the basketball. This involves positioning a rectangular structure above the head of the user so that the user is forced to project the basketball through an aperture in the structure. This device fails to address what we believe are the key aspects of the movements involved in proper foul shooting and further fails to provide instructional feedback to the user.

We have come to observe and understand much about free-throw shooting techniques both good and bad. Because of the uniform circumstances presented by the free-throw, other than a small inherent randomness, the causes of shooting inaccuracy rest entirely with the player, technique, and training. By minimizing potential sources of such inaccuracy, the player's free-throw shooting percentage can be increased. Most, if not all, competitive basketball players at the junior high school, high school, college; and professional levels have sufficient hand/wrist strength to accomplish a free-throw with relatively slight movement of the upper torso and even less movement of the legs. Nevertheless, even some professional players go through very extreme movements during free-throw shooting. In particular, the player often starts standing erect and then initiates a cocking or setting movement: squatting with his legs; lowering his shooting arm so that the shooting elbow is significantly below the shoulder; and flexing that elbow outward. To attempt the shot, the player simultaneously extends his legs and shooting arm, bringing his elbow inward as the arm extends. We believe this extreme range of motion presents a significant source of shooting inaccuracy. At a first level, the greater range of motion from the set point to the release point increases the likelihood that the shooter's release position, speed, and the like may be other than optimal. At a second level, however, this is exacerbated by the fact that the longer range of motion puts the shooter in positions where he is more likely to be affected by fatigue. In particular, fatigued legs will greatly affect the amount of propulsion provided by the legs if the shooter makes a deep squat to the set position prior to shooting. Also, lowering of the shooting arm tends to bring the ball down to or below the level of the player's chin. As the player extends his shooting arm the ball passes in front of the player's face, moving through the line of sight to the rim so that the player must refocus on the rim as the shot is taken.

We have accordingly provided a method for teaching a player to shoot free-throws with a shooting technique configured to minimize sources of error and the effects of fatigue, thereby, maximizing accuracy. To implement this method, we have designed an apparatus which, while confining the practicing player to a desired range of motion, does so in such a way that the player ultimately experiences the exact same sensory inputs as in the absence of the apparatus.

Accordingly, in one aspect the invention is directed to a device for training a person to accomplish a basketball shot, by way of example a foul shot. The device includes a generally vertically extending frame and a horizontally extending support, supporting the frame. A lower body positioning member is supported by the support or the frame and is located in front of a leg area of the person when that person is in a position to attempt the shot. When the person so attempts the shot the lower body positioning member restrains forward rotation of the person's leading shin. Preferably in addition to the lower body positioning member, but optionally alternative thereto, an upper body positioning member is supported by the support or the frame and is located in front of a torso area of the person. When the person attempts the shot, the upper body positioning member restrains downward rotation of the person's shooting arm.

In various implementations of the invention, at least one ball rack may hold a number of basketballs reachable by the person when in the position. There may be two such ball racks each secured to an associated upright of the frame. An elbow positioning member may confine outward rotation of the person's shooting elbow. The elbow positioning member may include a vertically-extending pad carried by the upper body positioning member. The positioning members may be height adjustable to accommodate different persons. The upper and lower body positioning members may be positioned to respectively contact a tricep area of the shooting arm and the leading shin upon threshold movement of such arm and shin. The upper body positioning member may be positioned to restrain (constrain or confine) movement of the upper shooting arm so that its elbow does not go below its shoulder. The lower body positioning member may be positioned to prevent movement of the leading knee beyond about 1 to about 3 inches (about 1.5 to about 7.5 cm) ahead of an initial knee position.

In another aspect, the invention is directed to a method for training a person to accomplish a desired basketball shot.

A training apparatus is provided which defines a location for the person to utilize the apparatus. The basketball goal is provided. The apparatus is positioned relative to the goal so that the defined location has a desired relationship to the goal. The person is positioned in the defined location in a preferred stance for the desired shot. A first member of the apparatus is positioned in front of a lower portion of the person. A second member of the apparatus is positioned in front of an upper portion of the person. In a repetitive process, the person is provided with a basketball and shoots the basketball at the goal. During the shot, an initial squatting movement of the person, causing a lower leg of the person to rotate forward or beyond a threshold rotation, will be restrained by the first member. An initial movement of the person, otherwise causing an upper arm portion of the person's shooting arm to rotate down to or beyond a threshold rotation, will be restrained by the second member (preferably little to no rotation is permitted). By this repetitive process the person learns to accomplish the shot without excessive rotation of the lower leg and upper arm. Advantageously, the shooter receives balls from racks positioned for access as close as possible to the desired initial position.

The details of one or more embodiments of the invention are set forth in the accompanying drawings and the description below. Other features, objects, and advantages of the invention will be apparent from the description and drawings, and from the claims.

Like reference numbers and designations in the various drawings indicate like elements.

Figure 1:
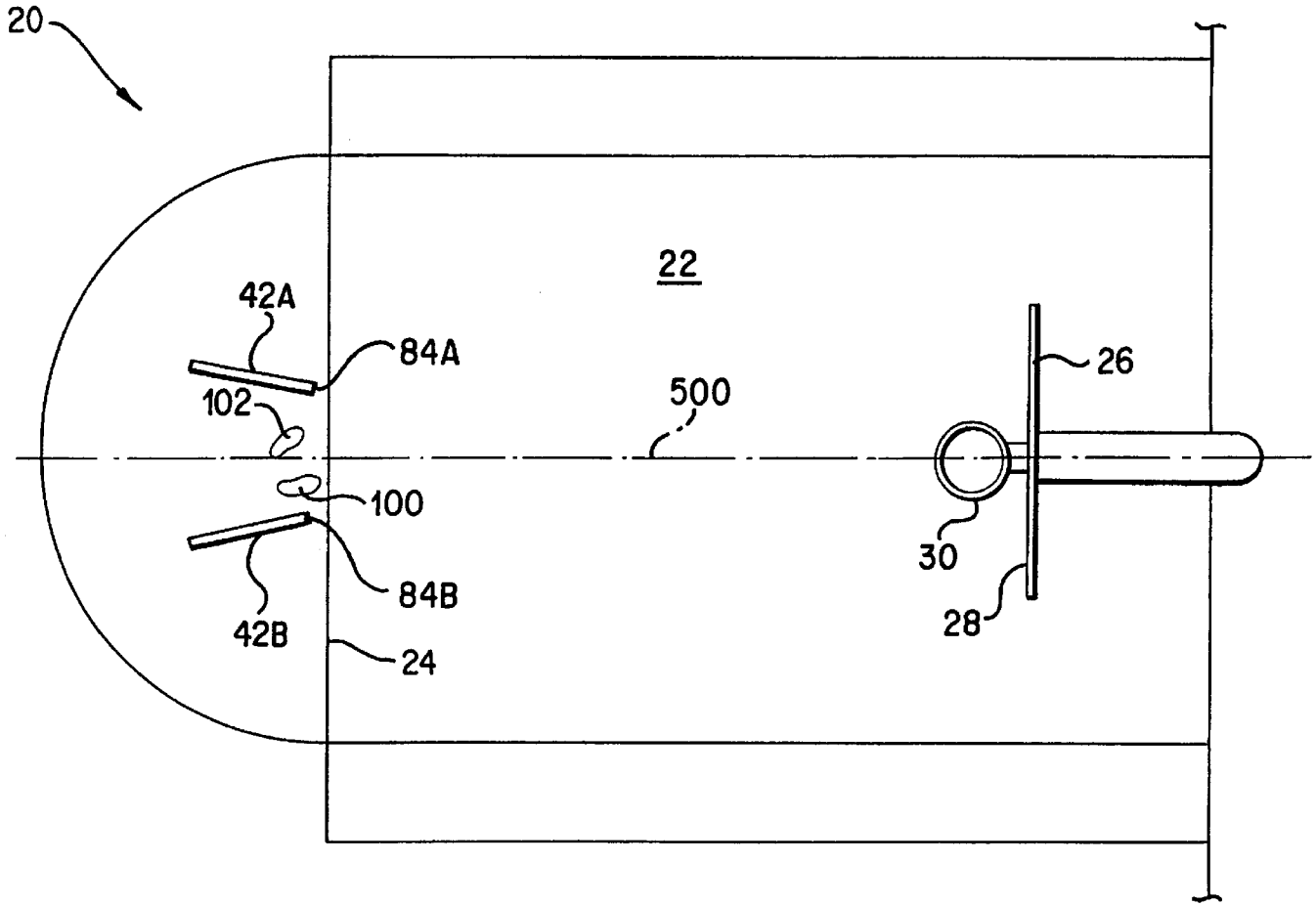
FIG. 1 is a top view of a basketball free-throw lane area.
Figure 2:
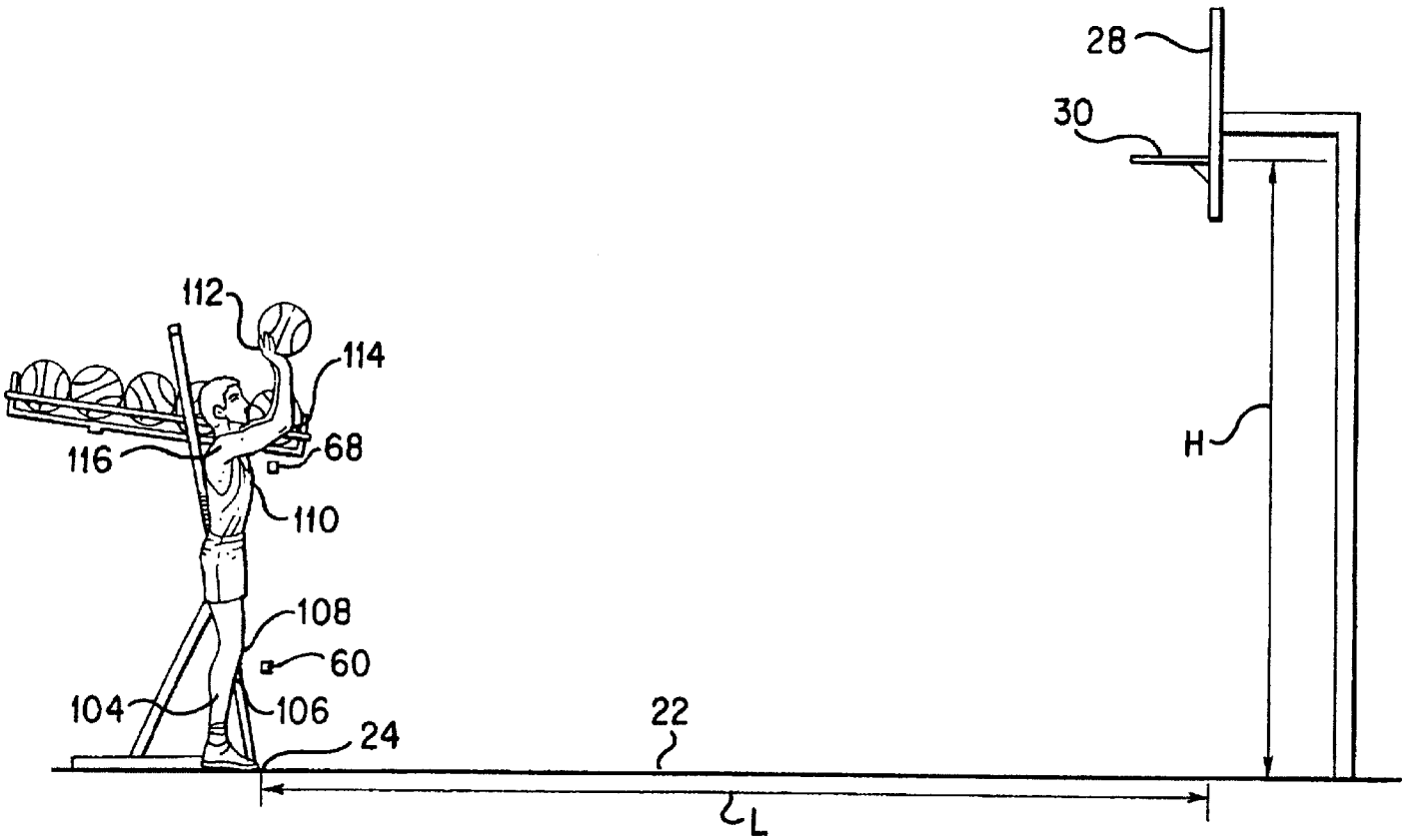
FIG. 2 is a partially schematic side view of a player preparing to shoot a free-throw with a free-throw training apparatus shown cut away.

FIG. 1 shows a free-throw lane of a basketball court 20. The court includes a floor 22 with a free-throw line 24 marked thereon. A backboard 26 is held above the floor and has a front surface 28. A basket rim or ring 30 is secured in front of the backboard. As shown in FIG. 2, the plane of the front surface 28 is a distance L away from the front edge of the free-throw line 24 and the upper edge of the rim 30 is a height H above the floor 22 (FIG. 2). Under universal basketball standards, L and H are respectively 15 and 10 feet (4.57 and 3.05 m).

For a right handed shooter, it is believed that advantageous foot positions are shown in FIG. 1 for the shooter's right and left feet/shoes 100 and 102. The feet are on opposite sides of the court centerline 500 so that the toe of the right shoe is just behind (from the shooter's viewpoint) the free-throw line 24. The left foot is in a toe-out orientation (pointed outward by approximately 10–30 degrees more than is the right foot) and is set back so that the toe of the left shoe is at least a few inches (for example 2–8 inches (5–20 cm)) behind the front edge of the free-throw line.

Figure 3:
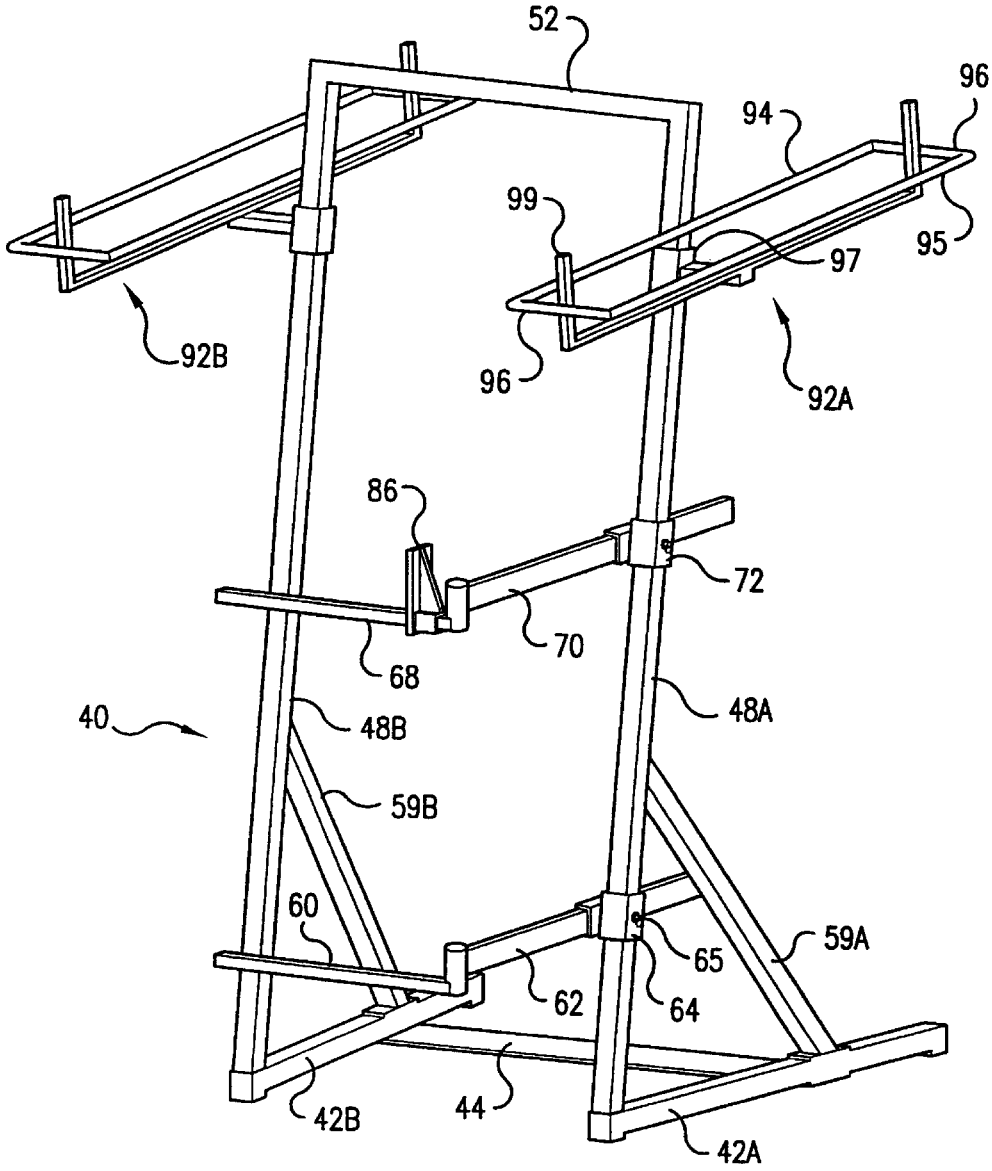
FIG. 3 is a view of a free-throw training apparatus according to principles of the invention.
Figure 4:
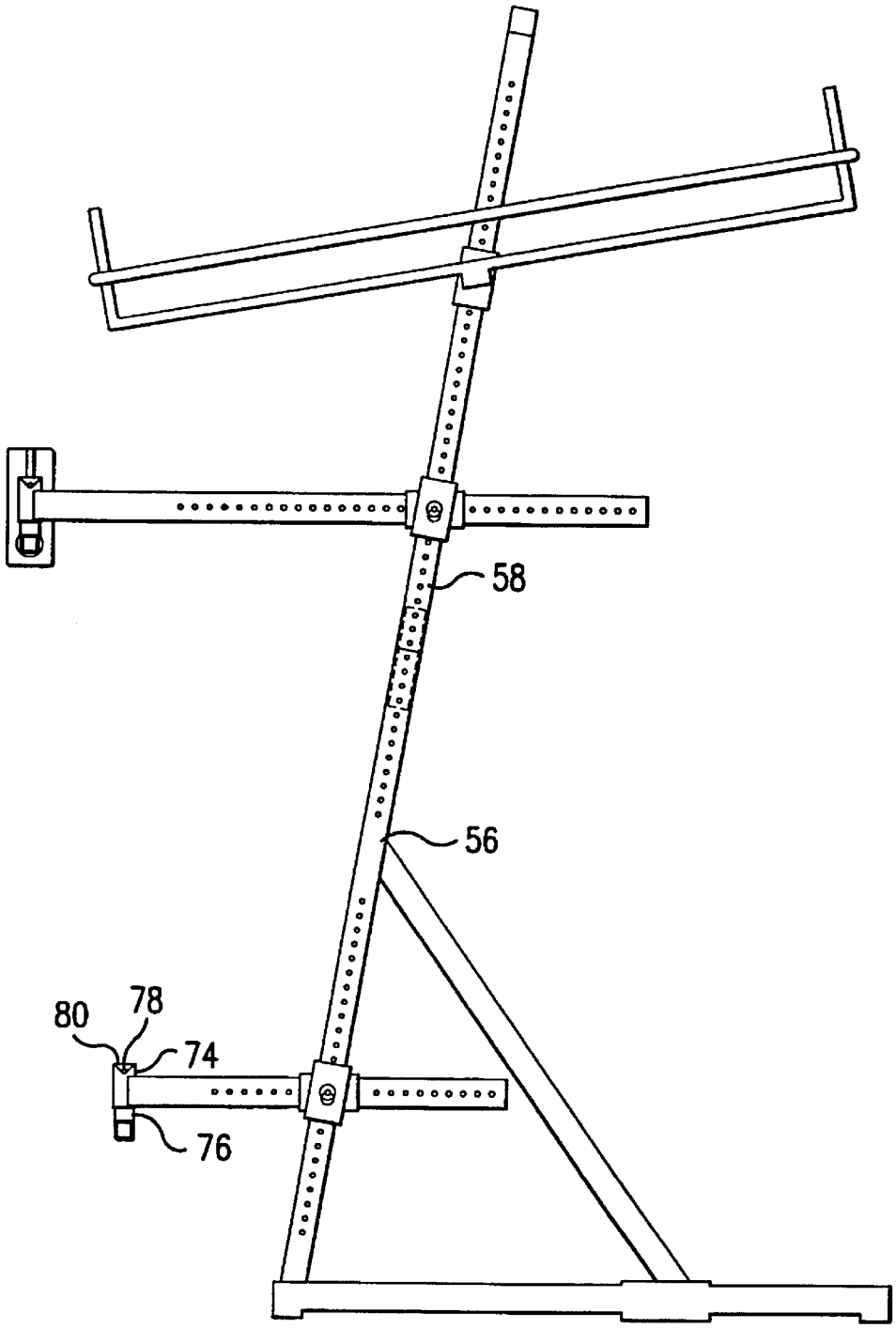
FIG. 4 is a side view of the free-throw training apparatus of FIG. 3.
Figure 5:
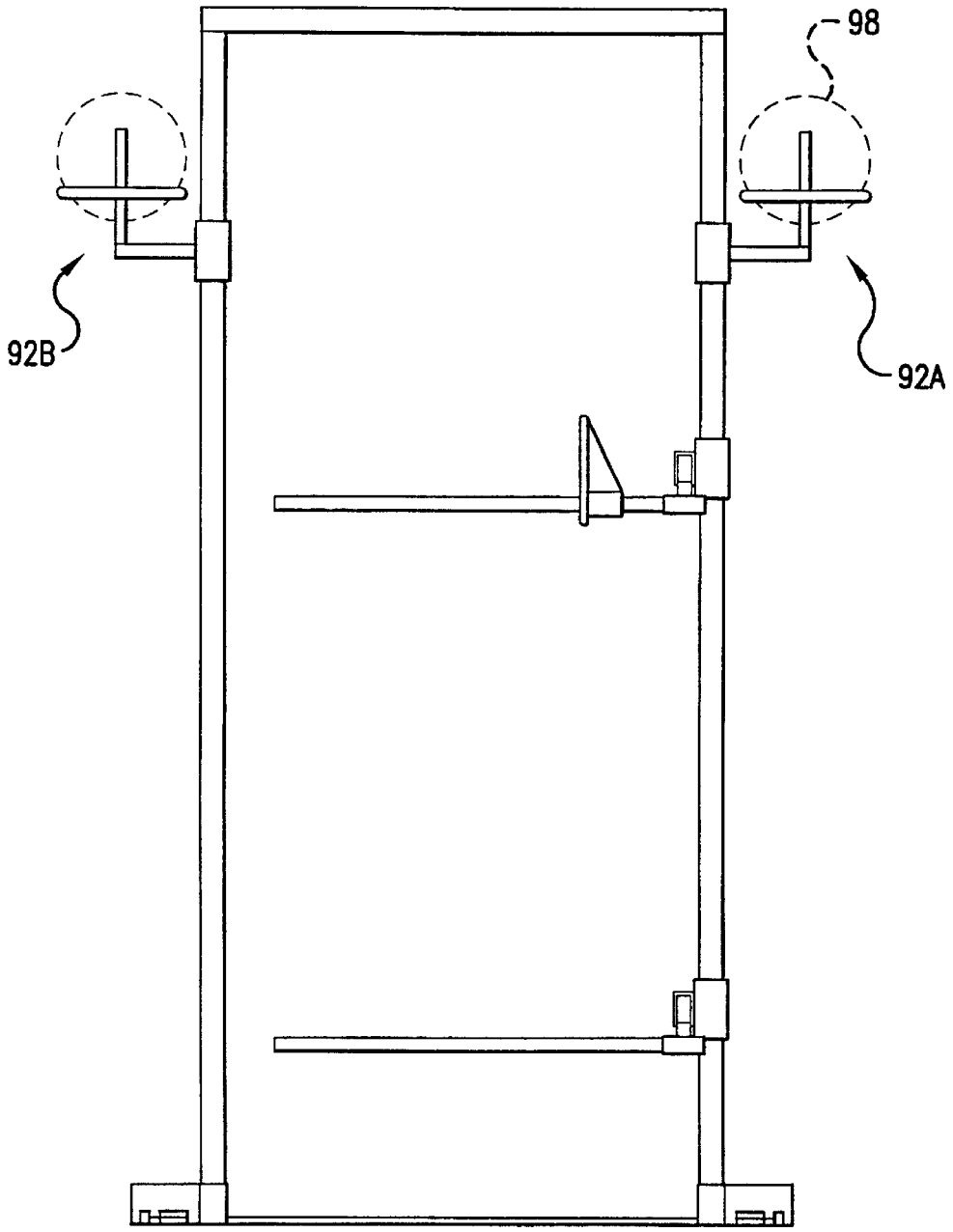
FIG. 5 is a front view of the free-throw training apparatus of FIG. 3.

FIGS. 3–5 show a training apparatus 40 according to principles of the invention. The apparatus includes a base formed of left and right generally longitudinal members 42A and 42B and a transverse crossmember 44 joining the left and right members. The base members may be permanently connected (such as by welding) or removably connected (such as by means of clamps). Exemplary longitudinal member material is two inch (5 cm) square section steel tubing having a 0.109 inch (0.28 cm) wall thickness while exemplary crossmember material is 6.0×⅜ inch (15×0.95 cm) steel bar stock to minimize interference with the user's feet. Extending upward from the base, a frame member includes left and right generally vertical members or uprights 48A and 48B secured at their lower ends to the base such as by welding or by clamps. A crossmember 52 of the frame connects the uprights preferably adjacent to the upper ends thereof and is secured to the uprights such as by interfitting, welding or clamps. Each upright 48A and 48B may include a lower portion 56 and an upper portion 58. Exemplary upright material is 1.75 inch (4.4 cm) square section steel tube having 0.120 inch (0.30 cm) wall thickness. Upper and lower portions may be secured to each other such as by means of an adapter tube (e.g., 1.5 inch (3.8 cm) square section by 0.95 inch (2.4 cm) wall thickness steel tube) telescoped within the portions and spanning the joint between. The adapter may be welded to one of the portions and secured to the other by a removable pin. Structurally reinforcing diagonal members 59A and 59B have upper ends secured to associated lower portions 56 and lower ends secured to associated longitudinal members 42A and 42B. Exemplary material is 1.75 inch (4.4 cm) square section by 0.095 inch (0.24 cm) thick steel tube.

Advantageously, the apparatus has members for restraining the shooter's setting movement when attempting the shot to provide feedback to the shooter. A horizontal crossarm 60 is secured at the distal end of a longitudinal arm 62 secured to one of the uprights by means of a collar 64. The collar may be supported by a pin 65 extending through holes on opposite sides of the associated upright. Exemplary holes may be at a pitch of 0.5 inch (1.27 cm) to provide height adjustment. A second crossarm 68 may similarly be secured at the distal end of a second longitudinal arm 70 secured to an upright by means of a second such collar 72. In operation, the crossarm 60 will be used to position and direct the shooter's leading shin while the crossarm 68 will be used to position and direct the shooter's upper shooting arm and is therefore located substantially above the crossarm 60. Exemplary material for the longitudinal arms is 2.0×1.0×0.072 inch (5×2.5×0.18 cm) wall thickness rectangular steel tube having an array of transverse through holes on 1.0 inch (2.5 cm) spacing to facilitate front-to-back position adjustment. Exemplary material for the crossarms is 1.0 inch (2.5 cm) square section by 0.035 inch (0.09 cm) thick by 36.0 inch (91 cm) long steel tube. To secure the crossarms to the associated longitudinal arms, the latter may each, at their forward ends, bear a vertical tube 74 which receives a smaller vertical tube 76 secured to a proximal end of the associated crossarm. A pin 78 carried by the inner tube 76 may bear against a rim of the outer tube 74 to vertically retain the crossarm. A relieved area or detent 80 may be provided to accommodate the pin in a preferred transverse orientation of the crossarm. The crossarm may be rotated about a central vertical axis of the inner and outer tubes producing a camming action of the pin against the rim to allow ingress and egress from the apparatus. This provides the crossarm with a gravity-biased return to the transverse orientation.

FIG. 1 shows an operative position for the apparatus with the front ends 84A and 84B of the base members 42A and 42B just behind the free-throw line 24 and the crossarms very close to the line. The preferred shooting position for the shooter is thus within the apparatus. It is noted that the "front" or "forward" direction for the apparatus faces the basket just behind the free-throw line.

With the apparatus so positioned relative to the free-throw line and rim, and the shooter positioned in the preferred initial shooting position and stance (FIG. 2), the crossarms 60 and 68 may be positioned to provide the desired restraint and direction. Specifically, the crossarm 60 extends parallel to the free-throw line and is located spaced in front of the lower leg 104 of the shooter, preferably, in front of an upper portion of the shooter's leading shin 106. For a right handed shooter, the separation is effective so that, upon a minimal flexion rotating the shooter's right knee 108 forward, his right shin will contact the crossarm after the shin has rotated a given amount from its initial standing orientation. An exemplary movement involves the right knee moving between about one and about three inches from its initial position. For a shooter with a two-foot long shin this involves a rotation of between about 2° and about 7°. The crossarm 68 may be positioned in front of the upper portion of the shooter's body. Specifically, it is located in front of the shooter's chest 110 at a desired height.

The shooter is provided with a basketball. An initial position of the shooter (FIG. 2) is standing generally upright, holding the basketball in his shooting hand 112 with the shooting elbow 114 pointed substantially forward elevated slightly relative to the shoulder 116 at a position spaced above the crossarm 68. The off hand (left hand, not shown) may be positioned supporting the basketball to the side of the shooting hand with the off elbow (not shown) directed laterally.

Figure 6:
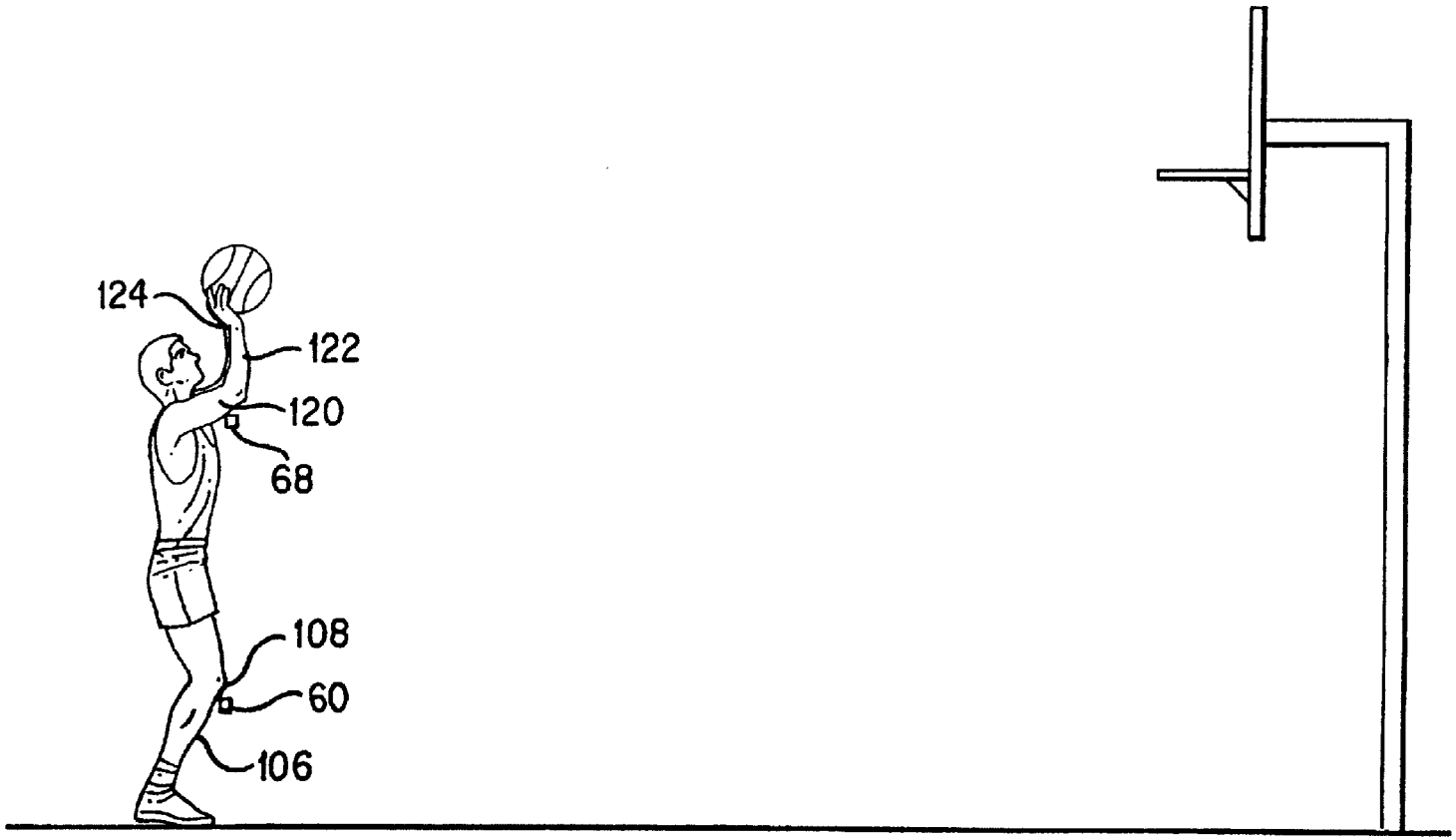
FIG. 6 is a semi-schematic side view of the player of FIG. 2 setting to take a free-throw shot.
Figure 7:
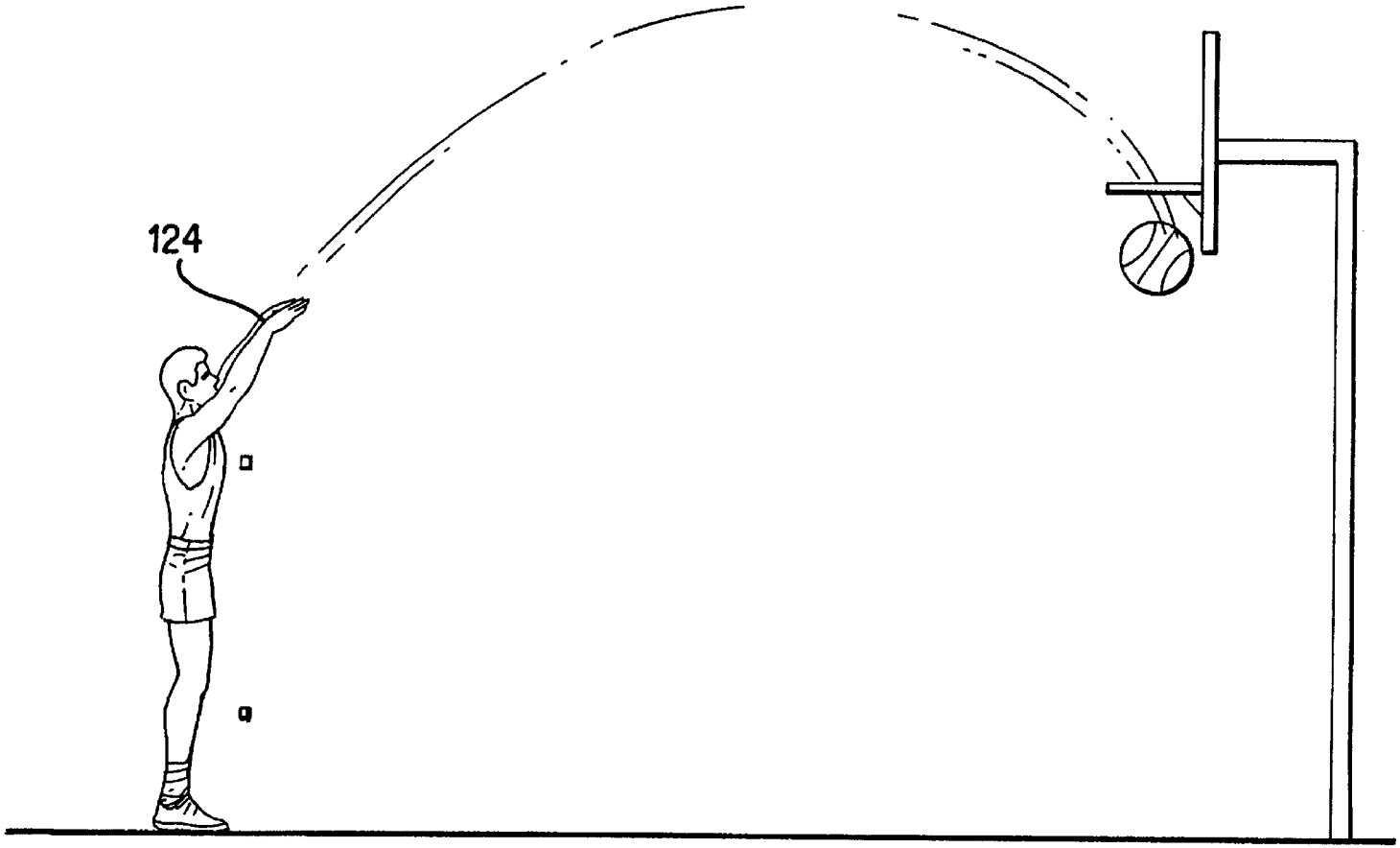
FIG. 7 is a semi-schematic side view of the player of FIG. 2 taking the shot.

When beginning to shoot the basketball, many shooters will be inclined to initially squat while both lowering and flaring out their shooting elbow. The extremes of these motions are undesirable sources of shooting inaccuracy. Thus, any initial squatting movement will cause the shooter's lower legs to rotate forward, bringing the right shin (for a right handed shooter) into contact with the crossarm 60 (FIG. 6), restraining further forward rotation of the lower leg. Any squatting movement also lowers the shooter's torso. The crossarm 68 is advantageously positioned so that, given the desired restrained flexion, the backside (tricep area) 120 of the shooter's upper shooting arm 122 will come into contact with the crossarm when the legs have rotated downward to the desired threshold with little to no downward rotation of the upper arm 122. Preferably, at this point, this threshold angle from the shoulder to the elbow is well above horizontal (e.g., in the vicinity of 30–40 degrees). Advantageously, the threshold angle is effective to prevent the ball from blocking the shooter's direct line of sight to the rim. Upon encountering these restraints of leg and arm motion, the shooter will then finish the shot by extending his legs and arms and launching the ball with a flick of his wrist 124 (FIG. 7). The process is repeated until the shooter has trained himself by ingraining the desired minimal flexion and movement and will build the muscle memory to accomplish the free-throw with the desired minimal motion. Since the shooter is not encumbered by devices attached to his body, when the apparatus is removed, the shooter will experience no change in sensation and, thereby, will be able to maintain the preferred repetitive motion achieved with use of the apparatus.

A number of options and modifications are available. Further restraint may be provided. An example of such is the provision of a pad 86 (FIG. 3) or other barrier on the crossarm 68 and/or longitudinal arm 70 to restrain lateral movement of the shooter's shooting elbow. Advantageously, the pad extends vertically and generally parallel to the court centerline. The transverse position of the pad 84 may be adjustable via sliding along the crossarm 68 and locking thereto by means of a screw clamp, release pin, detent mechanism, or the like. Although not believed advantageous, one of the crossarms could be omitted. For example, if the lower crossarm 60 were eliminated, the interaction of the upper crossarm with the tricep would still tend to restrain the shooter's ability to squat.

Figure 8:
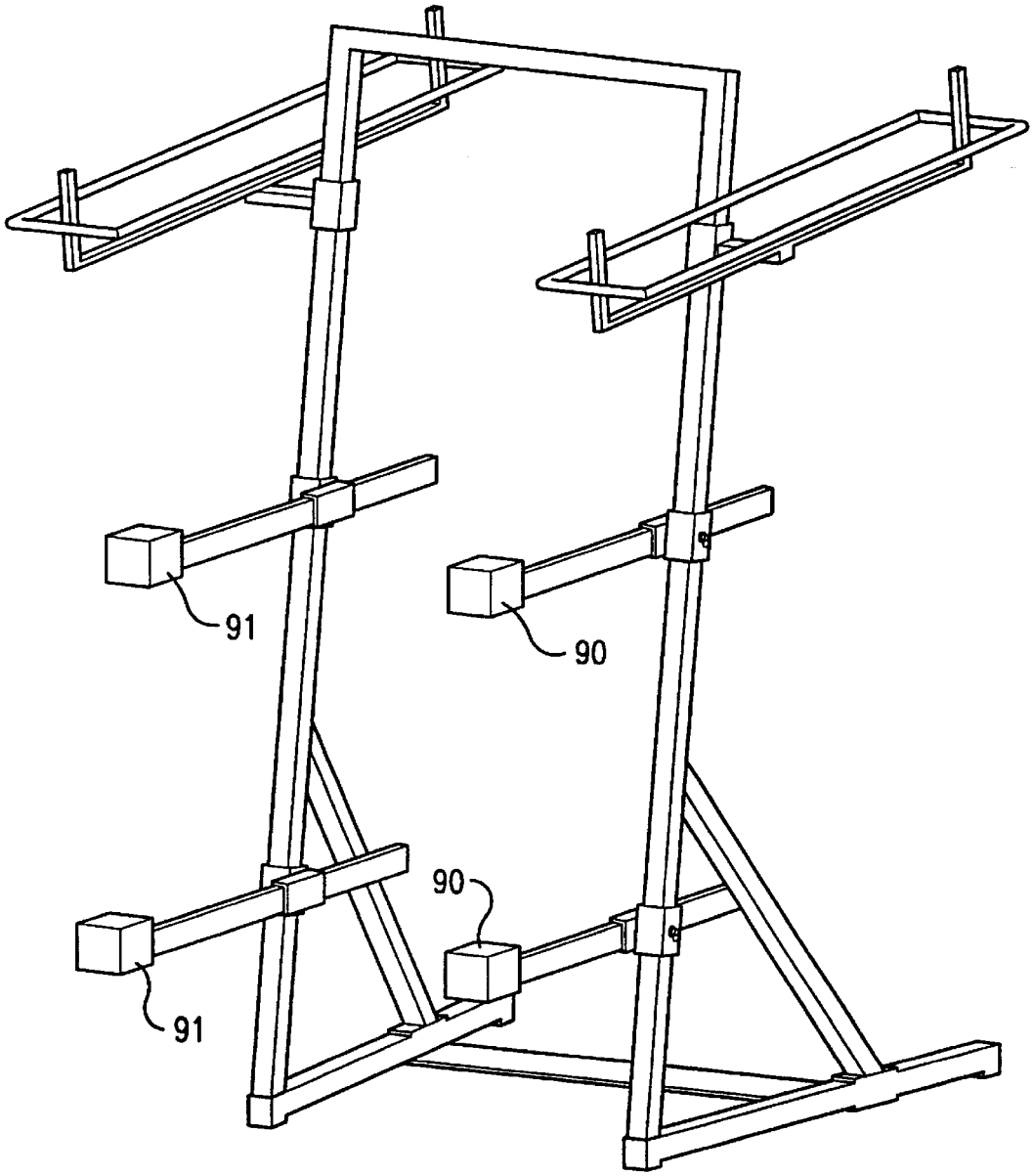
FIG. 8 is a view of a second free-throw training apparatus according to principles of the invention.

Furthermore, the various physical restraints which physically interrupt and stop motion may be replaced or enhanced by non-physical feedback restraints. For example, the crossarms could be replaced by light beams with appropriate sources 90 and detectors 91 (FIG. 8). Interaction of the lower leg and upper arm with the light beams (for example, interrupting the beams) would cause electronic circuitry (not shown) to provide an audible tone or other feedback to the shooter indicating that his movement has met or exceeded a desired threshold. This feedback would be utilized to train the shooter to maintain his motion within a tolerable amount. Such an electronic system might be particularly useful in a high end professional training apparatus which could include various additional sensors and monitoring equipment such as a pressure sensor array on the floor to check the shooter's balance and a computer monitor to display the parameters of the shooter's form and performance.

Another advantageous feature of the apparatus is the provision of one or more integrated ball racks. FIGS. 3 and 5 show left and right such racks 92A and 92B mounted on outboard sides of the respective left and right uprights. Each rack includes inboard and outboard rails 94 and 95 connected by crossmembers 96. A collar or clamp 97 secures each rack to the associated upright. The racks extend generally front to back and are angled downward in the forward direction. To prevent basketballs 98 carried by the rack from rolling off, an upright 99 is provided at the front end of the rack to block forward movement of the basketballs. The upright may be formed as one vertical portion of a U-shaped member centrally connecting the rack crossmembers 96 and supported by the collar 97 to support the rack. In operation, the shooter removes the foremost ball from a rack. The remaining balls roll forward, the next ball taking the place of the previous ball. This allows the shooter to execute a series of shots without having to move out of position to get new basketballs and without the need for another individual to act as a feeder. Advantageous arrangement places at least five basketballs on each rack so that the shooter can shoot ten shots before collecting the basketballs and reloading the racks.

Although illustrated in FIGS. 3–5 configured for use by a left handed shooter, the apparatus is preferably convertible for use with right or left handed shooters or may be made ambidextrous without need for conversion. By way of example, the crossarms and their associated longitudinal arms may be removed from the right side of the apparatus and mounted on the left side of the apparatus to accommodate a left handed shooter. Alternatively, there could be two sets of crossarms and longitudinal arms with both sets being hinged (e.g., at the elbow or junction between the crossarm and longitudinal arm) or otherwise articulatable to allow one set to be placed in a stowed condition while the other set is in a deployed condition for use by the shooter.

As noted above, one or both crossarms may be stowed or removed. With the upper or lower crossarm stowed, the user may, respectively, concentrate on movements of his or her lower or upper body. Stowing both crossarms may help in verifying proper form. If the crossarms are redeployed after a period of time, this may provide information on how well the shooter has imprinted the desired shot form. Optionally, deployment of only the lower crossarm may be useful to teach jump shooting. Deployment of only the upper crossarm may be useful to simulate a defender. An additional attachment may be provided, for example to the upper crossarm, to more effectively simulate the defender.

One or more embodiments of the present invention have been described. Nevertheless, it will be understood that various modifications may be made without departing from the spirit and scope of the invention. For example, a wide variety of materials and construction techniques may be utilized. Fixed or deployable wheels, rollers, or the like may be added for ease of mobility. The uprights need not be exactly vertical and the longitudinal members need not exactly extend longitudinally and horizontally. Rather, the former is advantageously sufficiently vertical to deploy the key components such as one or both of the crossarms and the ball racks while the latter should be effective to provide a relatively unintrusive base. The apparatus may be alternately configured, especially if additional or fewer features are desired. Although most relevant to foul shots, the apparatus and method may be applied to teaching proper technique for accomplishing other shots. Accordingly, other embodiments are within the scope of the following claims.

What is claimed is:

1. A method for training a person to accomplish a desired basketball shot comprising:

providing a training apparatus (40) which defines a location for the person to utilize the apparatus;

providing a basketball goal (26, 30);

positioning the apparatus relative to the goal so that the defined location has a desired relationship to the goal;

positioning the person in the defined location in a preferred stance for the desired shot;

at least one of:

positioning a first member (60) of the apparatus in front of a lower portion of the person, wherein the lower portion is at or between the person's knee and ankle; and positioning a second member (68) of the apparatus in front of an upper portion of the person, wherein the upper portion is at or between the person's waist and shoulder; and repeatedly:

providing the person with a basketball (98); and as the person performs an unaided range of motion and shoots the basketball at the goal at least one of:

restraining, with the first member, a lower leg of the person from rotating forward to or beyond a threshold rotation; and restraining, with the second member, an upper arm portion of the person's shooting arm from rotating down to or beyond a threshold rotation, so that the person learns the range of motion for shooting the basketball without excessive rotation of the lower leg and upper arm while experiencing the same sensory input as in the absence of the training apparatus.

2. The method of claim 1 comprising both said steps of:

positioning said first member; and positioning said second member.

3. The method of claim 1 wherein:

the restraint of the rotation of the upper portion of the shooting arm is by physical contact with the second member; and the restraint of the rotation of the lower leg is by physical contact with the first member.

4. The method of claim 1 wherein:

the first member comprises a first light source (90) and a first detector (91) and the restraint of rotation of the lower leg is by feedback responsive to interaction of the lower leg with a beam extending between the first source and first detector; and the second member comprises a second light source (90) and a second detector (91) and the restraint of rotation of the upper portion of the shooting arm is by feedback responsive to interaction of the shooting arm with a beam extending between the second source and second detector.

5. The method of claim 1 wherein said step of positioning a second member further comprises positioning a third member (86), integrated with the second member, and wherein, if the initial movement of the person causes the elbow of the shooting arm to rotate outward, such outward rotation to or beyond a threshold outward rotation will be restrained by the third member.

6. The method of claim 1 wherein the desired shot is a foul shot and wherein the positioning step places the person standing behind the foul line.

7. The method of claim 1 wherein the person is provided with the basketballs from a rack on the apparatus and positioned so that the person does not need to reposition himself or herself between shot attempts.

8. A method for training a person to accomplish a desired basketball shot comprising:

providing a training apparatus (40) which defines a location for the person to utilize the apparatus;

providing a basketball goal (26, 30);

positioning the apparatus relative to the goal so that the defined location has a desired relationship to the goal;

positioning the person in the defined location in a preferred stance for the desired shot;

positioning a first member (60) of the apparatus in front of a lower portion of the person, wherein the lower portion is at or between the person's knee and ankle;

positioning a second member (68) of the apparatus in front of an upper portion of the person, wherein the upper portion is at or between the person's waist and shoulder; and repeatedly:

providing the person with a basketball (98); and having the person shoot the basketball at the goal so that at least one of:

an initial flexion of the person, causing a lower leg of the person to rotate forward to or beyond a threshold rotation, will be restrained by the first member; and an initial movement of the person, causing an upper arm portion of the person's shooting arm to rotate down to or beyond a threshold rotation, will be restrained by the second member, so that the person learns to accomplish the shot without excessive rotation of the lower leg and upper arm.

9. The method of claim 8 wherein:

the restraint of the rotation of the upper portion of the shooting arm is by physical contact with the second member; and the restraint of the rotation of the lower leg is by physical contact with the first member.

* * * * *